US009738365B1

(12) United States Patent
Radwan

(10) Patent No.: US 9,738,365 B1
(45) Date of Patent: Aug. 22, 2017

(54) POWERED-ARM SWIMMING AID

(71) Applicant: Adel Radwan, Tom's River, NJ (US)

(72) Inventor: Adel Radwan, Tom's River, NJ (US)

( * ) Notice: Subject to any disclaimer, the term of this patent is extended or adjusted under 35 U.S.C. 154(b) by 0 days.

(21) Appl. No.: 15/155,432

(22) Filed: May 16, 2016

(51) Int. Cl.
*B63H 16/18* (2006.01)
*A63B 31/10* (2006.01)

(52) U.S. Cl.
CPC ..... *B63H 16/18* (2013.01); *A63B 31/10* (2013.01)

(58) Field of Classification Search
CPC ..... A63B 31/10; A63B 35/02; A63B 31/08; A63B 31/12; B63C 9/11; B63H 1/36; B63H 16/08; B63H 16/12; B63H 16/16; B63H 16/18; B63H 16/20; B63H 1/37
USPC ..... 441/56; 440/14, 15, 25, 26
See application file for complete search history.

(56) References Cited

U.S. PATENT DOCUMENTS 3,440,994 A * 4/1969 McGowan ..... A63B 35/02 440/15
4,832,631 A * 5/1989 Gag ..... B63H 16/04 440/101
5,348,503 A * 9/1994 Fechtner ..... A63B 31/11 440/101
5,649,845 A * 7/1997 Fechtner ..... A63B 31/11 440/101
9,248,344 B2 * 2/2016 Radwan ..... B63H 1/36

* cited by examiner

*Primary Examiner* — Lars A Olson
(74) *Attorney, Agent, or Firm* — Alston & Bird LLP

(57) ABSTRACT

This invention is related to an apparatus and a method for aquatic propulsion by use of a swimming aid comprising an anchoring article and handles that are compressed and retracted in a scissor-like fashion by a User. This inward and outward motion translates by way of a pivot point to the other end of the handle, causing another set of arms operably connected to the anchoring article by way of two sets of straps, to pivot in a manner perpendicular to the motion of the handles, thus causing two vertical fins to move laterally through the water, displacing water, and propelling the user in a forward direction. In a preferred embodiment of the present invention, foldable fin arms are attached to the second set of arms that is manipulated by the straps.

1 Claim, 4 Drawing Sheets

POWERED-ARM SWIMMING AID

FIELD OF THE INVENTION

This invention relates to a novel apparatus for aquatic propulsion. The invention uses a combination of swim handles, swim arms, and swim fins to generate forward thrust and propel a swimmer through the water.

BACKGROUND

Over the years a variety of designs have been developed that aim to assist a swimmer in aquatic propulsion. However, in comparison to these previous designs, the invention described herein achieves aquatic propulsion generated by the user's upper body motion which powers swim arms with swim fins that push water to propel a swimmer forward. Furthermore, the present invention utilizes levers and torque to translate a relatively small range of motion by a user with minimal effort to a wide range of motion by the water-pushing fins. In an embodiment of the invention, the fin arms are collapsible, wherein the motion of the swim fins against the flow of water causes the fin arms to fold back and minimize drag caused by the resistance of the water. This collapsible fin arm also folds up and abuts a limiting component when the fin arm is pushing the user forward, whereby the apparatus will generate forward thrust through the water.

DEFINITIONS

This section provides definitions for some of the terms used in this application. More specifically, the terms Swim Arms 1, Fin Arms 2, Main Head 3, Elbows 4, Fins 5, Swim Handles 6, Lower Elastic 7, Upper Elastic 8, Center Elastic 9, and Pivot Point 10.

Swim Arms 1—In a preferred embodiment, the Swim Arms 1 are approximately 1.5 to 2 feet in length, and are made of an aluminum tube or other similar lightweight, strong material. The Swim Arms 1 are connected by way of a rotatable joint to the Main Head 3 by the upper fin straps, such that the joint between the Swim Arms 1, described in further detail below as the point where the Swim Arms 1 meet each other, is allowed to move within the arc defined by the Main Head 3. Additionally, as described in further detail below, the Center Elastic 9 passes through the entirety of the Swim Arms 1.

Fin Arms 2—The Fin Arms 2 are, in a preferred embodiment, also made from aluminum tubes, or other similar lightweight, strong material. On one end, the Fin Arms 2 each are attached to the Fins 5. On the other end of each Fin Arm 2 is an attachment to one of the Elbows 4. The Fin Arms 2 are approximately the same length as the Swim Arms 1, and in a preferred embodiment they are approximately 1.5 to 2 feet in length. Given the attachment to the Elbow 4 opposite the Swim Arm 1, the Fin Arm 2 remains rigid, and therefore parallel to the Swim Arm 1, when the Swim Arm 1 is moving backwards through the water towards the user. However, when the Swim Arm 1 is moving forward through the water, away from the user, the Fin Arm 2 pivots inward to reduce resistance. Additionally, as described in further detail below, the Center Elastic 9 passes through the Fin Arms 2, and is fastened at the end of the Fin Arm 2 where the Fin 5 is attached.

Main Head 3—The Main Head 3 is, in a preferred embodiment, comprised of aluminum or other similar lightweight, strong material, in an arc-shape. Included on the Main Head 3 are a connections to the Swim Arms 1, as discussed further below. Also included on the Main Head 3 is an anchor ring, through which the Upper Elastic 8 passes. In this preferred embodiment, the Main Head 3 is configured to allow the user to operate the apparatus under the water. In another embodiment, the Main Head 3 can be made of, or covered in a buoyant material, thus providing a buoyant force that assists in balancing the user and keeping them along the top of the water for a varied type of swimming.

Elbows 4—The two Elbows 4 connect the Swim Arms to the Fin Arms, and in a preferred embodiment they are made of aluminum, or other similar lightweight, strong material. The Swim Arm 1 fits inside one end of the Elbow 4 with a screw, while the other end of the Elbow 4 connects the Fin Arms 2 with a screw, in such a way as to allow it to pivot when the Swim Fin is moved away from the user through the water. Therefore, it pivots and folds back towards the user to prevent resistance while moving forward through the water, but then folds out to become rigid when the swim arm is moving backwards towards the user through the water, allowing it to push water and propel the swimmer forwards.

Fins 5—The Fins 5 are made from plastic, wood, or aluminum, and, in a preferred embodiment, are shaped as a crescent moon to maximize the amount of water moved with a single stroke while simultaneously minimizing water resistance.

Swim Handles 6—In a preferred embodiment, the Swim Handles 6 are made from aluminum, or other similar lightweight, strong material, and are approximately 2.5 feet long. The Swim Handles 6 are connected by way of a rotatable joint to the Swim Arms 6 by fin straps that allow the Swim Handles 6 to pivot. The Swim Handles 6 are operably connected to each other at a joint that secured allows the Swim Handles 6 to move in a scissor-like fashion.

Lower and Upper Elastic 7 and 8—Two Elastic, the Lower Elastic 7 and the Upper Elastic 8, both are connected to anchor rings positioned on the ends of the Swim Arms 1, with one side of the Elastic being connected to one Swim Arm 1, and the other side of the Elastic attached to the other Swim Arm 1. When connected to the anchor rings, the Elastics are stretched to provide enough force that will ensure that the apparatus performs power strokes and pushes water backward to propel the swimmer forward when the apparatus is in use. In an embodiment the Upper Elastic 8 also passes through the Anchor Ring located on the top of the Main Head 3. In an embodiment the Lower Elastic 7 passes through the Fin Straps that connect the Swim Handles 6 to the Swim Arms 1. The Upper Elastic 8 is of such material that it is harder to stretch than the Lower Elastic 7, and therefore provides a greater force when outstretched than does the Lower Elastic 7. Furthermore, the force provided by the Upper 8 and Lower Elastic 7 can be adjusted by replacing the Elastics with those of different elasticity, allowing for a more effective Power Stroke, or less difficult resetting of the Swim Arms 1 to the normal configuration, depending on the User and Elastics selected. When the Swim Handles 6 are brought together by the User, the restorative force of the Lower Elastic 7 provides an upwards force on the Swim Arms 1, thus aiding the User in the Power Stroke that moves the Fin Arms 2 backwards and causes forward propulsion. As the Swim Handles 6 move apart, the Fin Straps pivot along a rotatable connection point, providing upward force to the Swim Arms 1 while still allowing them to fold in a scissor-like fashion, thus translating the upward motion of the Swim Handles 6 to the backwards motion of the Fin Arms 2. This motion of the components with respect to each other can be seen by comparing FIG.

4A, which shows the preferred embodiment of the present invention before moving to the Swim Handles 6 together, to FIG. 4B, which depicts the preferred embodiment after the Swim Handles 6 are brought together. Given the greater elastic force provided by the Upper Elastic 8, when there is no force being provided to the Swim Handles 6 by the user, the Upper Elastic 8 retracts and pulls the Swim Arms 1 upward, and the Fin Arms 2 pivot backwards due to the resistance of the water. This in turn aids the User to perform another Power Stroke without exerting much force to return the invention to its original position with the Swim Arms 1 facing upwards.

Center Elastic 9—The Center Elastic 9 is a device with elastic properties, such as a Elastic or elastic cord, that is routed through the Swim Arms 1 and the Fin Arms 2, extending from the end of the right Fin Arm 2, through the right Swim Arm 2, through the end of the left Swim Arm 1, until it is connected at the end of the left Fin Arm 2. The Center Elastic 9 provides an elastic force within the four components it traverses (i.e., both Fin Arms 2 and both Swim Arms 1), forcing the components to snap back to a straight alignment, thus reducing the burden on the User. This brings the Fin Arms 2 back into alignment with the Swim Arms 1 after every Power Stroke taken by the User.

Pivot Point 10—The Pivot Point 10 is a spring mechanism. In a preferred embodiment, the Pivot Point 10 extends approximately an inch and a half inside the Swim Arms 1, with each end connected through a hole in the hollow shaft of the Swim Arms 1 on either side of the present invention. The Pivot Point 10 is contained within the hollow Swim Arms 1, and allows the Swim Arms 1 to flex in relation with one another from an acute angle in the downward direction, to a flat position where the Swim Arms 1 are parallel to one another, and finally to an acute angle in the upward direction. The Pivot Point 10 should be a sufficiently elastic spring, or other similarly elastic material, such that after being stretched during the apparatus's use, it exerts a restoring force to bring it back to its original shape and length. This restorative force thus causes the Swim Arms 1 to return to the neutral position.

Other Components include:

(i) Fasteners—Fasteners such as screws and nuts may be used to connect the components.

(ii) Guide Wires—Guide wires that are of sufficient gauge to withstand the upward and downward forces of the invention when in use are operably connected to either end of the Main Head 3 by looping around the fasteners that connect the Main Head 3 to the Swim Arms 1. Guide wires can restrict the range of motion of the present invention so that the joint between the swim handles can move closer to the Main Head 3, but at no point can the Swim Handles 6 move further away from the Main Head 3 than it is located when the guide wire is fully taut.

(iii) Anchor Rings—There are five Anchor Rings used in the preferred embodiment of the present invention. The first of which is located on the top of the Main Head 3. There are two more Anchor Rings placed on the top side, near each end, of each Swim Arm 1, left and right. The last two Anchor Rings are placed on the bottom side of each Swim Arm 1, placed an equal distance from the end of the Swim Arm 1 as the Anchor Rings on the top side. The Anchor Rings on the top side are connected to either end of the Upper Elastic 8, which travels through the Anchor Ring located on the top of the Main Head 6. The Anchor Rings on the bottom side are connected to either end of the Lower Elastic 7, which travels between the Swim Handles 6 in the space between the point where the two handles meet and the Pivot Point.

(iv) Lower and Upper Fin Straps—The Lower Fin Straps are the mechanisms by which the Swim Handles 6 and the Swim Arms 1 are connected to each other. In a preferred embodiment, the Fin Straps are flat rectangles made of a lightweight metal, connected by way of a rotatable joint on both sides. The preferred embodiment of the present invention utilizes four such Lower Fin Straps, with one set of Lower Fin Straps on the left side of the invention, and another set on the right, on both the front side and back of the Swim Arms 1 and Swim Handles 6. The Upper Fin Straps are another set of four Fin Straps, instead connected by way of a rotatable joint to the Swim Arms 1 and the Main Head 3. The Upper Fin Straps are connected to the Swim Arms 1 further up than the Lower Fin Straps, with the distance between them approximately two inches in a preferred embodiment. The Upper Fin Straps are connected to the Main Head 3 on the inner ends of the right and left side, and are positioned on the front and back of the Swim Arms 1 and the Main Head 3.

DETAILED DESCRIPTION OF THE PREFERRED EMBODIMENT(S)

Figure 1:
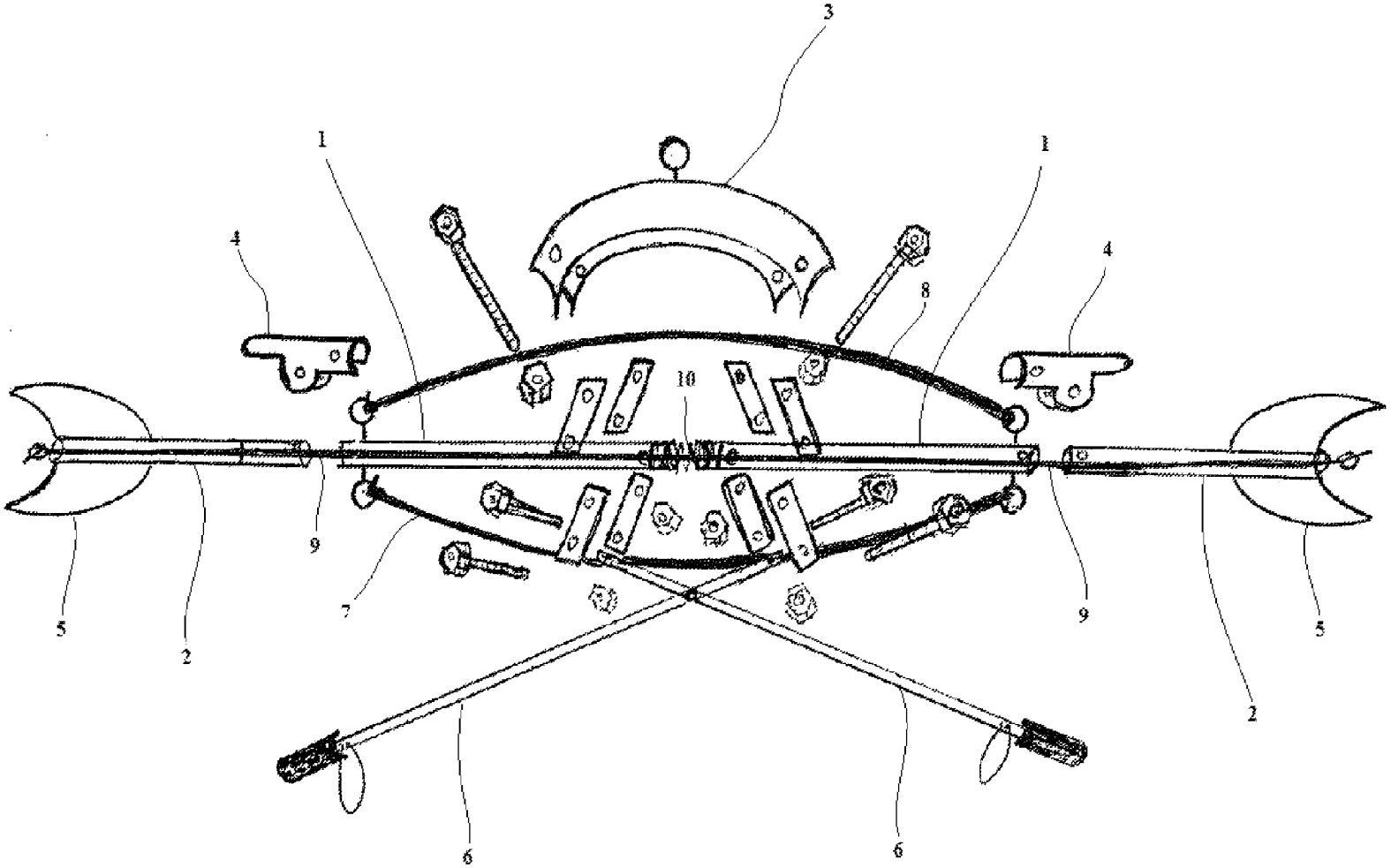
FIG. 1 illustrates an "exploded" view (a drawing that shows the relationship of various parts by slightly separating each component by an equal distance, suspended in surrounding space) of a preferred embodiment of the Powered-Arm Swimming Aid.
Figure 2:
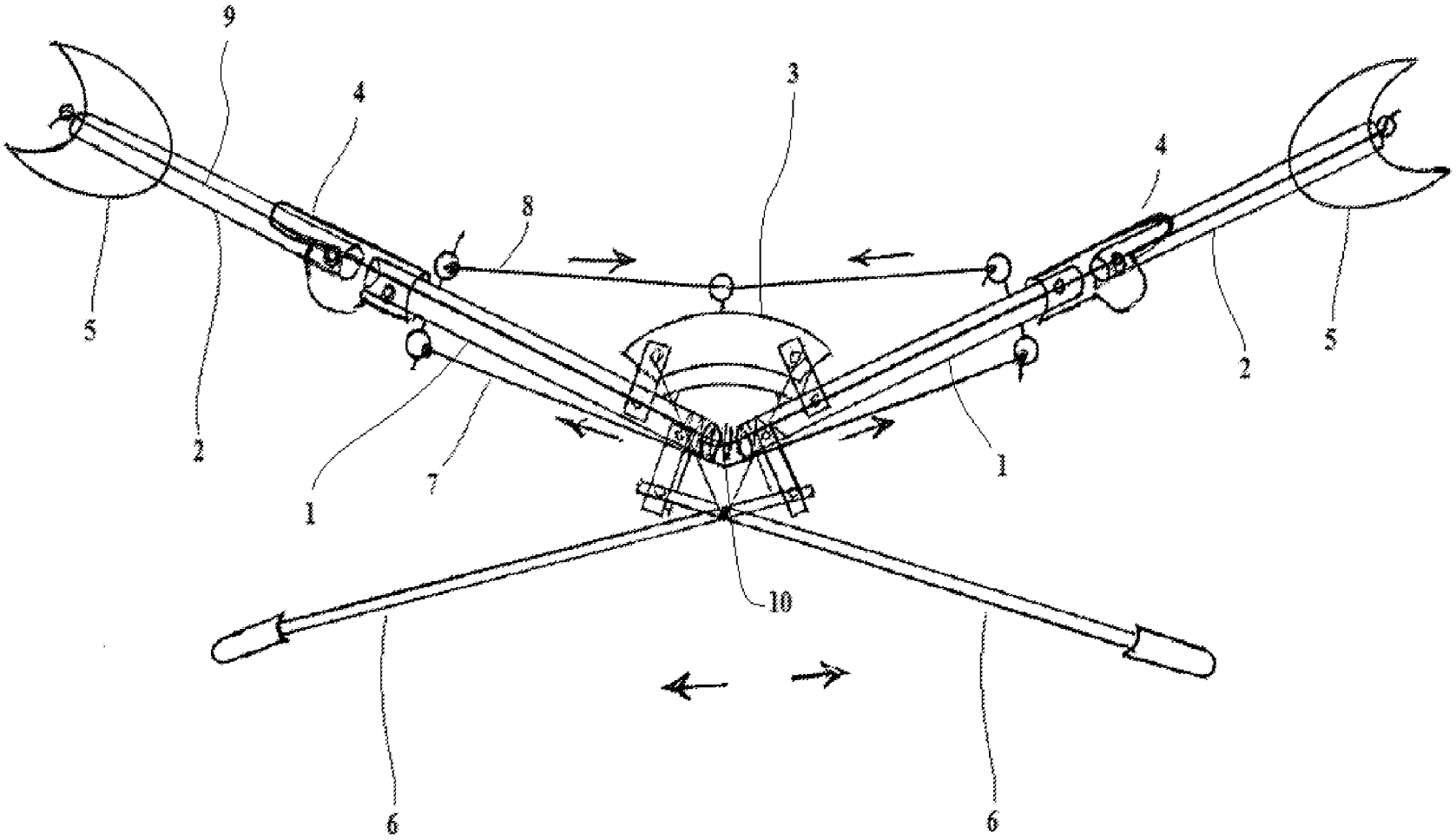
FIG. 2 illustrates a preferred embodiment of the complete Powered-Arm Swimming Aid in its normal configuration while not in motion. This configuration comes as a result of the greater force provided by the Upper Elastic 8, which causes the Swim Arms 1 to settle at an angle away from the user when not in motion. The Swim Handles 6 are in an open position, before being brought together.

With reference to FIG. 2, a User holds the present invention with both hands by way of the Swim Handles 6 at the end near the handles and straps, and positions the Main Head 3 in the direction in which the User would like to move. The User begins operating the present invention by moving the Swim Handles 6 towards each other, initiating the power stroke. As a result of this motion by the Swim Handles 6 at the end where the User holds them, the Swim Handles 6 pivot, causing the other end of the Swim Handles 6, where the lower fin straps are connected by rotatable means, to move inwards. This inward motion forces the lower fin straps to rotate with respect to the Swim Handles 6, pushing the end of the lower fin straps, which are connected by rotatable means to the Swim Arms 1, away from the user. In an embodiment, a guide wire may restrict the distance between the Main Head 3 and the joint where the swim handles meet, keeping the joint from extending past a maximum distance. As the innermost end of the Swim Arms 1 moves away from the user, the upper fin straps, connected by rotatable means a short distance down the Swim Arms 1, force the outer ends of the Swim Arms 1 to move toward the user as depicted in FIG. 2. This process is aided by the connection by rotatable means between the Main Head 3 and the upper fin straps, which keeps the Swim Arms 1 from moving laterally with relation to the Main Head 3.

Figure 3:
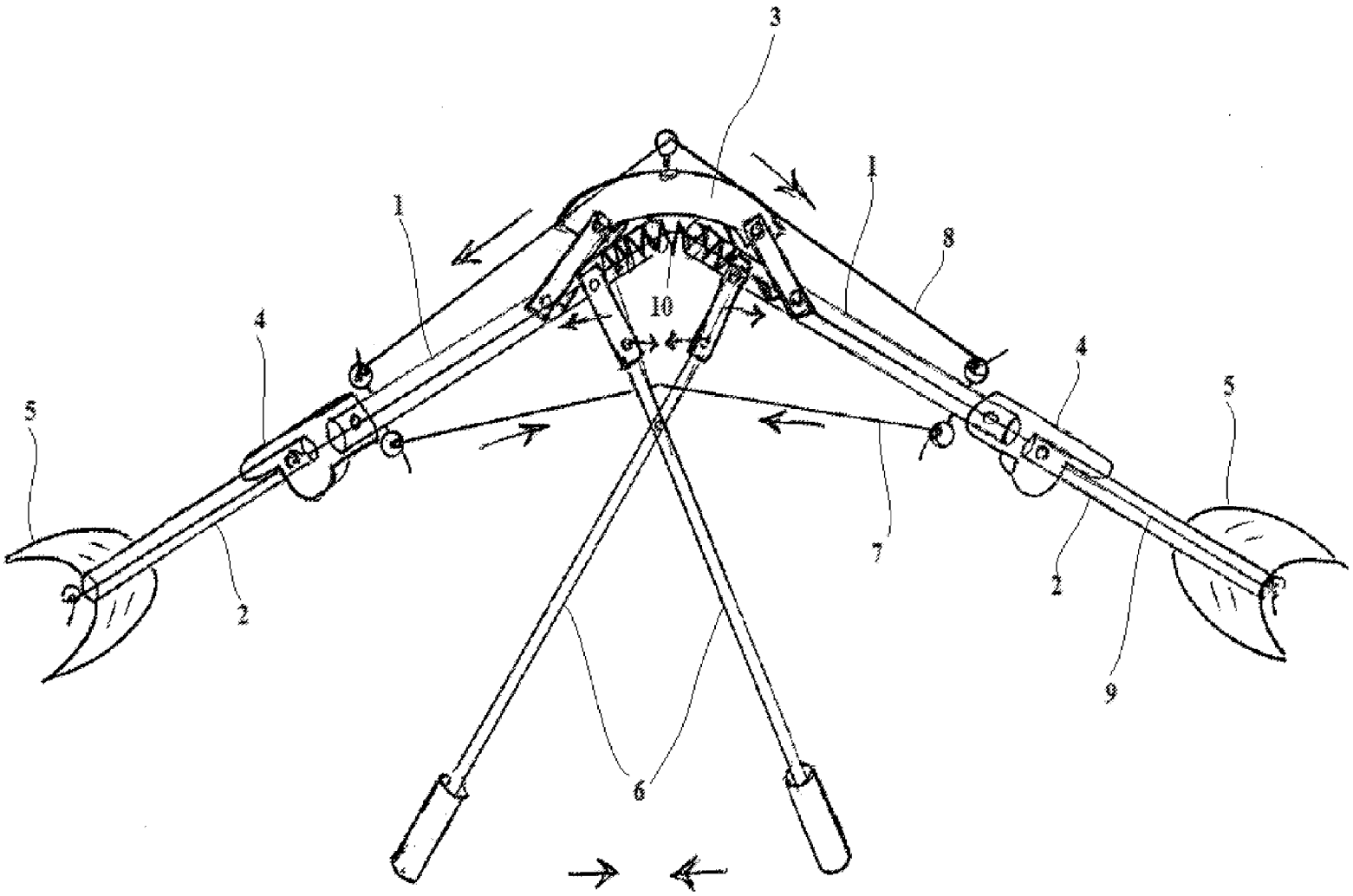
FIG. 3 illustrates the preferred embodiment of the complete Powered-Arm Swimming Aid in the configuration after the User has performed a power stroke by bringing the two Swim Handles 6 together. As the Swim Handles 6 are brought together by the User, the Swim Arms move toward the user, stretching the Upper Elastic 8. As the Swim Arms 1 move toward the user, the Fin Arms 2 also move toward the user, and are pushed by the resistance of the water into the Elbows, forcing each pair of Swim Arms 1 and the Fin Arms 2 to straighten and fully extend. This allows the user to move water with more force. It can also be seen that the Pivot Point 10 is in a bent position, pulled to that position by the power provided by the User when pushing the Swim Handles 6 together.

As the Swim Arms 1 pivot toward the user as shown by comparing FIG. 2 to FIG. 3, the Pivot Point 10 bends to help control lateral movement and stabilize the device. Additionally, the forces on the Lower Elastic 7, which is connected to the anchor rings that are operatively attached to the lower side of the left and right Swim Arms 1, travels through the junction between the Swim Arms 1, are decreased. Furthermore, the Center Elastic 9 provides another stabilizing force that pulls the Swim Arms toward a straight, parallel configuration. These forces, in conjunction with the force provided by the User's inwards motion on the Swim Handles 6, overpowers the resistance provided by the Upper Elastic 8.

Figure 4A:
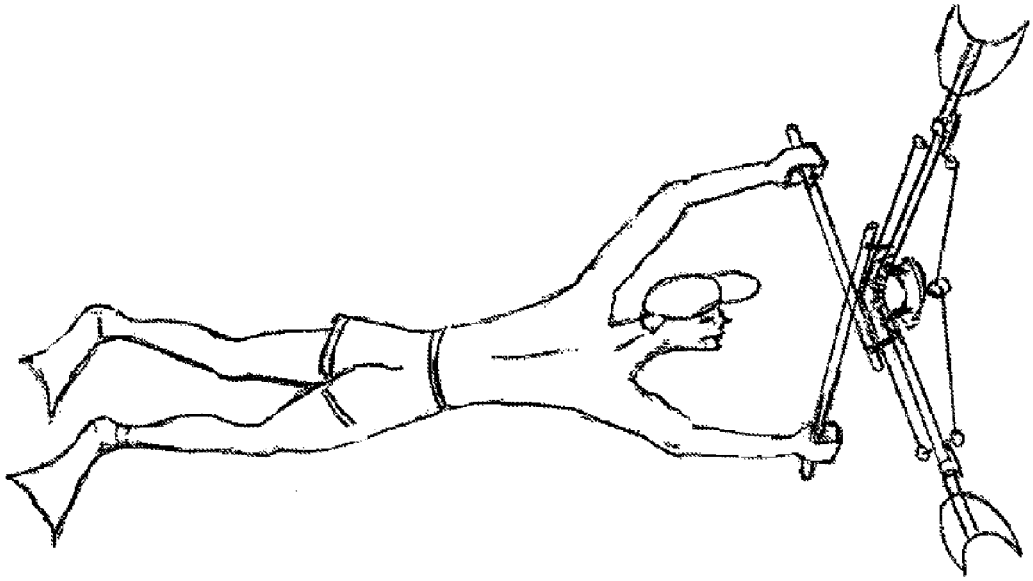
FIG. 4A shows an embodiment of the present invention in the upward position where the Swim Arms are extended; this configuration is what is referred to as the normal configuration. In this position, the Upper Elastic is in its retracted state, bringing the Swim Arms upwards, while the Lower Elastic is extended below the junction between the two Swim Arms where the Pivot Point and the portion of the Swim Handles opposite the user grips.
Figure 4B:
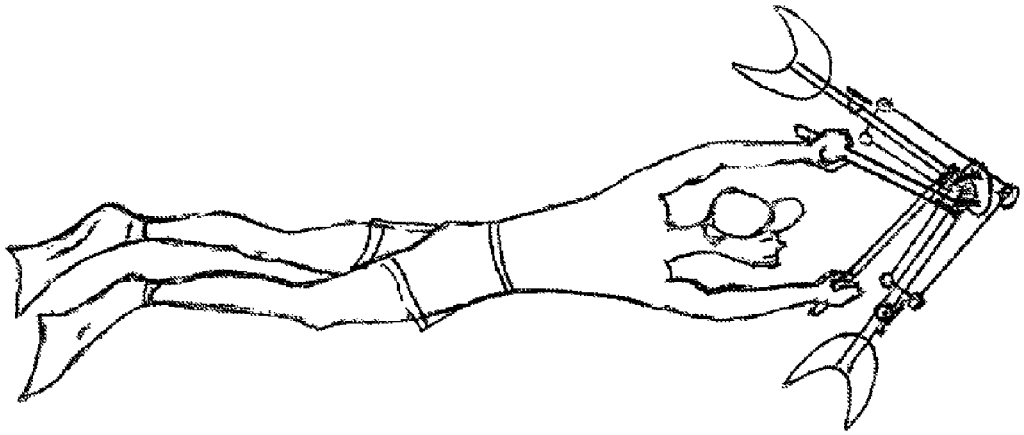
FIG. 4B depicts the Swim Handles, Swim Arms, Fin Arms, among other components, of an embodiment of the present invention in a configuration where the Swim Arms are positioned toward the user. This configuration is that of the present invention immediately following the power stroke. As can be seen by comparing FIGS. 4A and 4B, the junction point between the Swim Arms has moved a short distance away from the user, causing the fins to move a great distance, thus propelling the User forward by pushing water toward the user. In the position immediately following the power stroke as depicted in FIG. 4B, the Swim Handles have been brought together, pushing the ends of the Swim Arms upwards, aided by the retracting force of the Lower Elastic. This movement stretches the Upper Elastic, which allows for a Elastic-aided retraction of the Swim Arms back to the normal configuration at the completion of the power stroke. As a result of the length of the Swim Arms and the Fin Arms combined, the short range of motion of the Swim Handles causes the Swim Arms and Fin Arms to make powerful strokes through the water, resulting in a power stroke that propels the User forward.

As the Swim Arms 1 are forced toward the user by the upper fin straps, the water resistance on the Fins 5 pushes them, along with the Fin Arms 2, to a flat orientation in parallel with one Swim Arm 1 each. The Fins 5 are prevented from hyperextending past the flat orientation by the Elbow 4, which keeps the Fin Arm 2 at the parallel position with respect to the Swim Arm 1. This flat orientation provides maximum extension for the arms of the present invention, and translates the inward motion of the Swim Handles 6 to the large distance traveled by the Fins 5, thus pushing water backwards toward the user and propelling the User forward. This range of motion is demonstrated by comparing FIG. 4A to FIG. 4B.

Once the User completes the Power Stroke, and the Swim Arms 1 are at the most downward angle allowed by the Main Head 3, the User begins to reset the present invention to the normal configuration shown in FIG. 2 by pulling the Swim Handles 6 outward. This outward motion is made easier by the retracting force of the Upper Elastic 8, pulling the Swim Arms 1 upwards by way of the anchor rings attached to the upper side of the Swim Arms 1, in addition to the expansion force provided by the Center Elastic 9.

As the Swim Arms 1 begin to angle upwards towards the normal configuration, the water resistance pushes the Fins 5 and Fin Arms 2 toward the user into a parallel configuration with the Swim Arms 1. Given that the Elbow 4 is open on the lower side of the Swim Arms 1 and the Fin Arms 2, the Fins 5 and Fin Arms 2 fold back towards perpendicular with respect to the Swim Arms 1, thus minimizing any drag caused by water resistance. Once the Swim Handles 6 are brought to the filly outstretched position, as shown in FIG. 2, the present invention has returned to the normal configuration and one cycle has been completed. The User would then continue to operate the present invention by repeating the above described power stroke.

What is claimed is:

1. A Powered-Arm Swimming Aid apparatus comprising:

a. two Swim Arms operably connected at the proximal end of each by a Pivot Point;

b. two Swim Handles pivotally attached to the Swim Arms, wherein the Swim Handles are connected to each other by a rotatable joint;

c. two Fin Arms, each of which is pivotally attached at its proximal end to one Swim Arm by way of an Elbow, such attachment allowing for partial rotation of the Fin Arms;

d. a Center Elastic running through both sets of the Swim Arms and the Fin Arms, secured to the outer ends of the Fin Arms;

e. a Main Head pivotally attached to each of the Swim Arms at the proximal end of each Swim Arm;

f. wherein each Swim Arm is attached at its distal end to (1) an Upper Elastic that is routed through an anchor ring on the Main Head and (2) a Lower Elastic routed between the Swim Arms and the Swim Handles.

* * * * *